US011646008B2

(12) United States Patent
Franzi et al.

(10) Patent No.: US 11,646,008 B2
(45) Date of Patent: May 9, 2023

(54) METHOD FOR BROADCASTING AN ACOUSTIC SIGNAL

(71) Applicant: Tissot SA, Le Locle (CH)

(72) Inventors: Edoardo Franzi, Cheseaux-Noreaz (CH); Alain-Serge Porret, Neuchâtel (CH)

(73) Assignee: Tissot SA, Le Locle (CH)

( * ) Notice: Subject to any disclaimer, the term of this patent is extended or adjusted under 35 U.S.C. 154(b) by 299 days.

(21) Appl. No.: 16/664,292

(22) Filed: Oct. 25, 2019

(65) Prior Publication Data

US 2020/0143780 A1 May 7, 2020

(30) Foreign Application Priority Data

Nov. 7, 2018 (EP) ..... 18205010

(51) Int. Cl.

| | |
|---|---|
| ***G04B 19/00*** | (2006.01) |
| ***G10K 9/125*** | (2006.01) |
| ***H04R 17/00*** | (2006.01) |

(52) U.S. Cl.

CPC ..... *G10K 9/125* (2013.01); *H04R 17/00* (2013.01)

(58) Field of Classification Search

CPC ..... G04B 19/00

See application file for complete search history.

(56) References Cited

U.S. PATENT DOCUMENTS

| | | | | |
|---|---|---|---|---|
| 4,242,745 | A | 12/1980 | Mutrux | |
| 4,334,280 | A * | 6/1982 | McDonald | G06F 3/016 968/968 |
| 4,847,818 | A | 7/1989 | Olsen | |
| 9,542,816 | B1 | 1/2017 | Mor et al. | |
| 10,680,161 | B1 * | 6/2020 | Bharadwaj | H04R 17/00 |
| 2003/0067440 | A1 | 4/2003 | Rank | |
| 2004/0203503 | A1 * | 10/2004 | Rollins | G08B 6/00 455/90.3 |
| 2010/0144395 | A1 * | 6/2010 | Komiya | H04M 1/724 345/173 |
| 2013/0142016 | A1 * | 6/2013 | Pozzo Di Borgo | G04G 9/0064 368/239 |

(Continued)

FOREIGN PATENT DOCUMENTS

| | | | |
|---|---|---|---|
| CN | 1599925 | A | 3/2005 |
| CN | 105323337 | A | 2/2016 |

(Continued)

OTHER PUBLICATIONS

Office Action dated Jul. 23, 2021 by the Korean Patent Office in Korean Application No. 10-2019-0140745.

(Continued)

*Primary Examiner* — Olisa Anwah

(74) *Attorney, Agent, or Firm* — Sughrue Mion, PLLC

(57) ABSTRACT

The invention relates to a method for broadcasting an acoustic signal to the wearer of a watch, the method comprising a step of identifying an event relating to a function of this watch (1) as well as a step of sending a configuration signal relating to said identified event to a sound interface (3) of the watch (1) comprising a plurality of piezoelectric elements (4) mounted on at least one deformable support element (9), said plurality of piezoelectric elements and said at least one deformable support element (9) being able together to produce a sound.

8 Claims, 1 Drawing Sheet

FIG. 2

(56) References Cited

U.S. PATENT DOCUMENTS

| | | | | |
|---|---|---|---|---|
| 2015/0154853 | A1* | 6/2015 | Yousef | G06F 3/011 340/539.11 |
| 2015/0358438 | A1 | 12/2015 | Kim et al. | |
| 2016/0023245 | A1* | 1/2016 | Zadesky | B06B 1/06 310/334 |
| 2016/0052020 | A1 | 2/2016 | Park et al. | |
| 2016/0058375 | A1* | 3/2016 | Rothkopf | G06F 3/015 600/301 |
| 2016/0100251 | A1* | 4/2016 | Bracco | H03F 3/217 381/59 |
| 2016/0187977 | A1* | 6/2016 | Cruz-Hernandez | G06F 3/016 345/156 |
| 2016/0261299 | A1* | 9/2016 | Hosoi | G06F 1/163 |
| 2017/0220005 | A1 | 8/2017 | Han et al. | |
| 2018/0153763 | A1* | 6/2018 | Tseng | A61H 11/00 |
| 2018/0231940 | A1* | 8/2018 | Kojima | G04G 9/00 |
| 2019/0188976 | A1* | 6/2019 | Aleksov | G08B 6/00 |
| 2020/0130011 | A1* | 4/2020 | Rauch | H01L 41/09 |
| 2021/0119106 | A1* | 4/2021 | Yoshida | H01L 41/09 |

FOREIGN PATENT DOCUMENTS

| | | | |
|---|---|---|---|
| CN | 205104519 | U | 3/2016 |
| JP | 55-78278 | A | 6/1980 |
| JP | 55-116292 | A | 9/1980 |
| JP | 56-69795 | | 6/1981 |
| JP | 58-123392 | U | 8/1983 |
| JP | 2-257739 | A | 10/1990 |
| JP | 11-515151 | A | 12/1999 |
| JP | 2003-47094 | A | 2/2003 |
| JP | 2004-159181 | A | 6/2004 |
| JP | 2005-528834 | A | 9/2005 |
| JP | 2010-136151 | A | 6/2010 |
| JP | 2011-141830 | A | 7/2011 |
| JP | 2016-46803 | A | 4/2016 |
| KR | 10-2015-0007591 | A | 1/2015 |
| KR | 10-1603266 | B1 | 3/2016 |
| KR | 10-2017-0089249 | A | 8/2017 |
| WO | 97/16035 | A1 | 5/1997 |
| WO | 03/032289 | A1 | 4/2003 |
| WO | 03/103018 | A2 | 12/2003 |
| WO | 2014/164018 | A1 | 10/2014 |

OTHER PUBLICATIONS

Communication dated Mar. 1, 2021 in Chinese Patent Application No. 201911075782.4.

English Translation of JP55-116292 published Sep. 6, 1980, previously cited Oct. 25, 2019.

Communication dated Apr. 24, 2019, issued by the European Patent Office in counterpart Application No. 18205010.4.

Notice of Grounds for Rejection dated Jan. 15, 2021 from the Korean Intellectual Property Office in KR Application No. 10-2019-0140745.

Communication dated Feb. 2, 2021, from the Japanese Patent Office in application No. 2019-201263.

Office Action dated Oct. 12, 2021 in Chinese Application No. 201911075782.4.

Office Action dated Sep. 28, 2021 in Japanese Application No. 2019-201263.

* cited by examiner

METHOD FOR BROADCASTING AN ACOUSTIC SIGNAL

CROSS-REFERENCE TO RELATED APPLICATION

This application claims the benefit of priority of European Patent Application No. 18205010.4 filed Nov. 7, 2018, the contents of which are incorporated herein by reference in their entirety.

TECHNICAL FIELD

The present invention relates to a method for broadcasting an acoustic signal to the wearer of a watch.

The invention also relates to a watch implementing this method as well as a computer program.

PRIOR ART

In the prior art, the reception of notification messages is conventionally indicated in watches by an alert consisting of the emission of an acoustic signal broadcast by an sound interface composed of a loudspeaker. However, such a sound interface consumes a large quantity of energy in the context of the functioning thereof which is then problematic for such watches, the energy capacity of which is limited.

It will be understood that there then exists a need to find an alternative solution, in particular which does not have the drawbacks of the prior art.

SUMMARY OF THE INVENTION

One aim of the present invention is consequently to propose a method for broadcasting an acoustic signal that consumes little energy, proposing a significant variety of different sounds able to be emitted by a watch.

Another aim of the invention is to propose a sound interface that is of small size or compact in comparison with the sound interfaces of the prior art.

For this purpose, the invention relates to a method for broadcasting an acoustic signal to the wearer of a watch, the method comprising a step of identifying an event relating to a function of this watch as well as a step of sending a configuration signal relating to said identified event to a sound interface of the watch comprising a plurality of piezoelectric elements mounted on at least one deformable support element, said plurality of piezoelectric elements and said at least one deformable support element being able together to produce a sound.

In other embodiments:

- the sending step comprises a substep of selecting a design criterion for the configuration signal relating to said identified event;
- the design criterion comprises operating data of the sound interface comprising at least one vibration frequency and at least one vibration amplitude both defined for each piezoelectric element constituting said interface;
- the information data comprise the duration of broadcasting of the acoustic signal;
- the information data comprise at least one operating instant/period of each piezoelectric element with respect to the duration of broadcasting, that is to say:
  - a single instant of functioning during all or part of the duration of broadcasting of the acoustic signal, or
  - a sequence of operating instants during the duration of broadcasting of the acoustic signal.

- the information data comprise, for each operating instant:
  - a vibration frequency and a vibration amplitude;
  - a vibration frequency and a sequence of vibration amplitudes;
  - a sequence of vibration frequencies and a sequence of vibration amplitudes, or
  - a sequence of vibration frequencies and a vibration amplitude;
- the configuration signal comprises separate instructions for controlling each piezoelectric element of the sound interface during the duration of broadcasting a message;
- the configuration signal participates in the separate control of each piezoelectric element of the sound interface contributing to producing:
  - the sound able to be broadcast to the wearer, or
  - the sound and a touch message able to be broadcast to the wearer.

The invention also relates to a watch, in particular a connected watch, implementing this method, comprising a processing unit and a sound interface provided with a plurality of piezoelectric elements, said processing unit being connected to said sound interface.

Advantageously, the sound interface is defined in the watch case and/or in the wristlet of this watch.

The invention also relates to a computer program comprising program code instructions for executing the steps of the method when said computer program is executed by a processing unit of a watch.

BRIEF DESCRIPTION OF THE FIGURES

Other particularities and advantages will emerge clearly from the description that is made thereof below, by way of indication and in no way limitatively, with reference to the accompanying figures, in which.

DETAILED DESCRIPTION OF THE INVENTION

Figure 1:
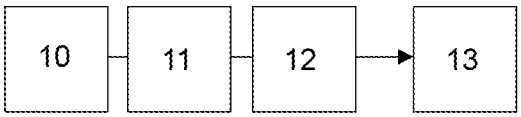
FIG. 1 shows a logic diagram relating to a method for broadcasting an acoustic signal to the wearer of a watch, according to an embodiment of the invention.

FIG. 1 illustrates a method for broadcasting an acoustic signal to the wearer of a watch 1. This method aims to advise/inform the wearer of the watch 1 of the identification of an event relating to one or more functions of the watch 1, and this by means of the broadcasting of an acoustic signal specific to the event identified. Such a method makes it possible to separately control piezoelectric elements 4 arranged in the watch 1 in order to participate in the production of this acoustic signal. For example, this acoustic signal can reproduce the noise of the "tick-tock" of a mechanical movement due to the movement of the direct drive when it "jumps" each second under the effect of a regulation mechanism such as a balance. In this particularly advantageous example for a watch 1 provided with an electronic movement, the event identified may be the activation of an operating mode of the watch for example by the choice of this operating mode in a contextual menu of the watch 1. It should be noted that this acoustic signal may be associated with a touch message relating to the detected event broadcast by an interface a tactile rendition interface of the watch 1 included in a sound interface of this watch 1. For example, following the identification of an event, in addition to the broadcasting of a sound/noise by the watch, a touch message specific to the event identified may also be broadcast to the wearer simultaneously or substantially simultaneously. Such a message may correspond, non-limitatively and non-exhaustively, to:

- the production of a contour of a graphical representation such as a pattern/symbol, a letter or a figure in a tactile manner, that is to say such as can be achieved by the movement of the tip of a finger of an individual on the skin of the wearer;
- the application of the graphical representation to the skin of the wearer, for example the application of the shape of a letter or of a symbol/pattern;
- the generation of an undulatory and/or vibratory phenomenon aiming for example to create for the wearer a tactile perception that is gentle, pleasant or sensuous or conversely unpleasant.

In this context, this touch message broadcast with the sound/noise in particular by means of the sound interface 3 enables the wearer to perceive the message tactilely in addition to the sound perceived audibly. In other words, the reception of this message by the wearer has recourse to a tactile sensory perception thereof. In one example, the wearer may perceive on his skin, in addition to the sound/noise, a sensation of a caress if the identified event relates to a missed call coming from his girlfriend or, in a variant, he may perceive on his skin the production of a contour in the shape of a heart.

Figure 2:
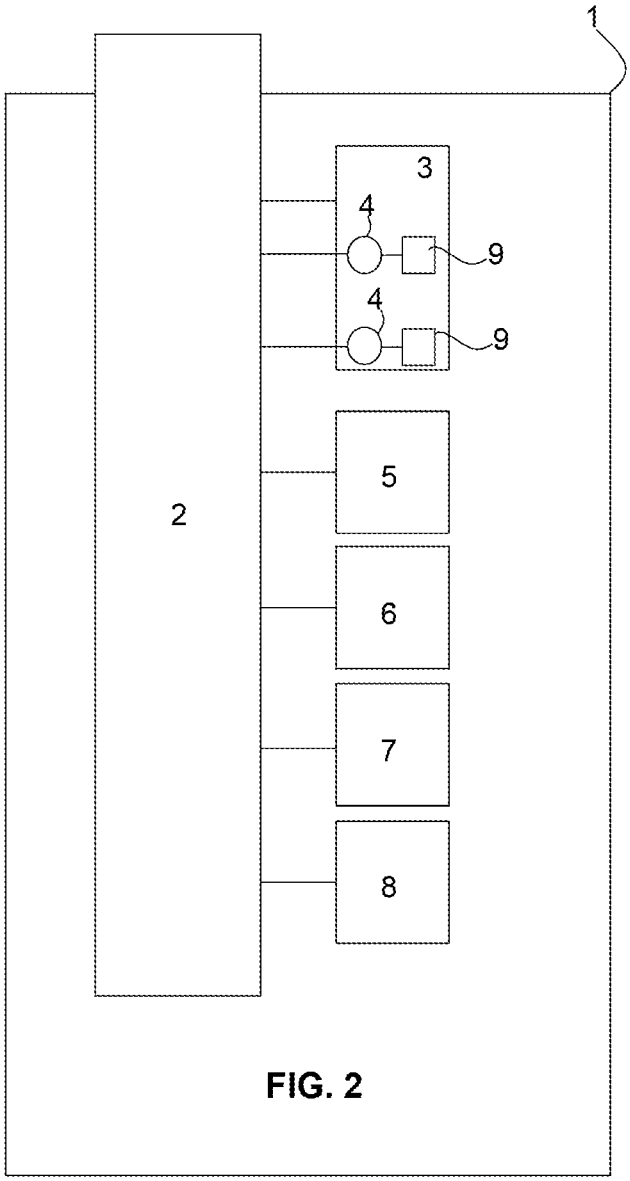
FIG. 2 shows a watch implementing this method, according to the embodiment of the invention.

Such a method is implemented by a watch 1, in particular a connected watch. Such a watch 1, visible in FIG. 2, comprises, non-exhaustively and non-limitatively:

- a processing unit 2 comprising hardware and software resources, in particular at least one processor cooperating with memory elements;
- the sound interface 3 comprises a plurality of piezoelectric elements 4, each element 4 being able to convert an electrical signal into mechanical oscillations/pulsations;
- the tactile rendition interface included in the sound interface 3 and therefore also comprising a plurality of piezoelectric elements 4;
- a hybrid display dial 5 provided with a first analogue display component and a second digital and/or alphanumeric display component;
- a communication module 6;
- a mechanical or electronic movement 7, and
- environmental, behavioural and/or physiological sensors 8.

This processing unit 2 of the watch 1 is linked/connected among other things to the sound interface 3, to the tactile rendition interface, to the piezoelectric elements 4, to the display dial 5, to the communication module 6, to the movement 7 and to the environmental, behavioural and physiological sensors 8.

In this watch 1, the sound interface 3 is defined in a watch case 1 and/or in a wristlet of this watch. This sound interface 3 and therefore also the tactile rendition interface comprises piezoelectric elements 4 and at least one deformable support element 9 associated with said piezoelectric elements 4. Each piezoelectric element 4 may for example be manufactured from a piezoelectric ceramic or a flexible piezopolymer material (polyvinylidene fluoride—PVDF), and may, non-limitatively, have a circular shape and/or be a film or membrane. Such a piezoelectric element 4 may have characteristic dimensions of around a few square millimetres or even a few square micrometres with a small thickness of approximately a few millimetres or even a few micrometres.

This piezoelectric element 4 is able to receive control instructions from the processing unit 2 in order to deform said at least one support element 9 by vibration. The deformable support element 9, also referred to as an acoustic support element 9, is for example a plate. It will be understood that the term "plate" is used here to define a substantially bidimensional element, the thickness of which is small compared with the length and width thereof. The plate may be curved and have a given curvature.

The deformation of the support element 9 by vibration is effected according to a vibration frequency range that makes it possible to produce an audible effect and therefore the generation of an acoustic signal, generating a movement of the air around the support element 9. The vibration frequency range is directly dependent on the material of the support element 9. By way of example, if the support element 9 is produced from PMMA, the corresponding frequency range extends from 20 Hz to 20 kHz. A given sequence of deformations of the support element 9 by vibration at high frequency can be envisaged so that the succession of audible effects forms music/a melody. It should be noted that it is not here the movement of the piezoelectric element 4 that directly produces the sound by disturbing the air close around, but it is indeed the movement of the support element 9 on which the piezoelectric element 4 rests that produces this disturbance and therefore the acoustic signal.

In a first example embodiment, the piezoelectric elements 4 of this sound interface 3 can be arranged over all or part of the surface of the support element 9 forming the back of the watch case 1. In a second example, these piezoelectric elements 4 may be arranged in the wristlet, in particular over all or part of the surface of a support element 9 included in at least one length of this wristlet. In a third example, these piezoelectric elements 4 can be arranged both in all or part of the surface of the support element 9 included in the back of the watch case and in at least one length of the wristlet. In a fourth example each piezoelectric element 4 of this sound interface 3 may be associated with a separate support element 9, in other words the sound interface 3 comprises as many piezoelectric elements 4 as it comprises support elements 9. Thus assemblies consisting of piezoelectric element 4 and support element 9 can be arranged in the watch case and/or in the wristlet. In a fifth example, the back of the watch case may be divided into a plurality of support elements 9 on each of which at least one piezoelectric element 4 can be disposed.

It should be noted that, in this watch 1, each piezoelectric element 4 is linked/connected separately to the processing unit 2. In other words, the processing unit 2 is able to control each piezoelectric element 4 of this sound interface 3 individually and/or separately.

It should be noted that the piezoelectric elements 4 and the deformable support element or elements 9 of the tactile rendition interface included in the sound interface 3 are disposed in the same way as those that are included in this sound interface 3. However, these elements 4, 9 of this tactile rendition interface are defined in all or just a portion of a part of the watch 1, said part being intended to be in contact with the skin of the wearer, for example that defined at his wrist. It should be noted that the tactile rendition interface may comprise a deformable support membrane in which the piezoelectric elements 4 and the deformable support element or elements 9 are arranged. In this example, this membrane may then be a part attached to the watch 1 while being fixed to the face giving contact with the skin of the wearer of the back of the watch case and/or to the face giving contact with the skin of the wearer of the wristlet. In a variant, this membrane may be made in one piece with the contact face of the back of the watch case 1 and/or the contact face of the wristlet.

In this watch 1, the communication module 6 is configured to establish a connection with a cellular network system by comprising in particular a SIM (the acronym for subscriber identity module) card or with a wireless local network system WLAN, and is also able to implement communication technologies such as for example Bluetooth. Under these conditions, the watch 1 is able to exchange data with a remote server, a computer or a computerphone.

Moreover, the environmental sensors 8 of the watch 1 are specifically suitable for measuring environmental parameters such as for example temperature, atmospheric pressure, etc. With regard to the behavioural sensors 8, these are able to measure all types of behavioural characteristics of the wearer of the watch 1, such as for example the movements or gestures made by him. To do this, these behavioural sensors 8 may comprise one or more inertial sensors of the accelerometer, gyroscope or miniature multiaxial gyrometer type such as multiaxial sensors manufactured in MEMS technology, capable of detecting angular velocities and linear accelerations along a plurality of axes associating accelerometers and/or gyroscopes. With regard to the physiological sensors 8, these are able to measure the parameters relating to the functioning an organism of the wearer such as for example the pulse, blood oxygen saturation, skin impedance, blood pressure, respiratory rate, respiratory arrythmia, skin temperature, perspiration rate, blood oxygen saturation or blood flowrate.

Such a method comprises a step 10 of identifying an event relating to a function of the watch 1. This watch 1 comprises in fact a set of functions. These functions relate, non-exhaustively and non-limitatively, to: the management of telephone calls, the management of short messages of the SMS or MMS type, the management of instantaneous messages, the measurement of an atmospheric pressure, the measurement of an altitude, the measurement of a temperature, the provision of sports results, navigation/guidance assistance, monitoring movement, measuring fast pulse rate, measuring the number of steps, a diary, a configuration of an operating mode of the watch (for example, an operating mode being the reproduction of a sound or noise of a mechanical movement such as "tic-toc"), an alarm, etc.

In this context, it should be noted that the identification of an event by the processing unit 2 may, non-limitatively and non-exhaustively, result from:

- the determination of a threshold being exceeded by a measurement coming from one or more sensors 8, in particular in the case of monitoring by this processing unit 2 of a behavioural or physiological parameter of the wearer or of an environmental parameter, etc.;
- the reception of a missed telephone call received by the processing unit 2 coming from the communication module 6;
- the reception of a short or instantaneous message or of an e-mail received by the processing unit 2 of remote servers via the communication module;
- the activation of an operating mode of the watch 1 (for example the mode relating to the "tick-tock" noise);
- a triggering of an alarm such as: an alarm for waking up, alarm for a meeting, alarm for taking a medication;
- etc.

The method next comprises a step 11 of sending a configuration signal relating said identified event to an sound interface 3 of the watch 1 comprising a plurality of piezoelectric elements 4 mounted on at least one support element 9 capable together of producing a sound. It should be noted that this sound interface, as we have mentioned, is also able to generate a touch message in addition to the sound/noise from the assembly formed by the plurality of piezoelectric elements 4 and at least one support element 9 included in the tactile rendition interface of this sound interface 3. This step 11 comprises a substep 12 of selecting a design criterion of the configuration signal relating to said identified event. In other words, this design criterion is defined according to the event identified. This design criterion is preferably previously configured by the wearer of the watch, like other design criteria particular to other identifiable events archived in the memory elements of the processing unit 2. Such a design criterion comprises an operating scenario of the piezoelectric elements 4 constituting the sound interface 3. This design criterion then participates in the design of the configuration signal participating in the generation of the acoustic signal intended to be transmitted to the wearer of the watch 1. By way of example, if the event identified is "the activation of an operating mode of the watch such as the tick-tock noise", then the design criterion of the configuration signal comprises an operating scenario that aims to design a configuration signal specifically defined for generating an acoustic signal representing the "tick-tock" noise of a mechanical movement. In a variant, a design criterion may participate in the design of the configuration signal contributing to the generation of the acoustic signal and of a touch message intended to be transmitted to the wearer of the watch 1. By way of example, if the event identified is "the triggering of the wake-up alarm" then the design criterion of the configuration signal comprises an operating scenario that aims to design a configuration signal specifically defined for generating an acoustic signal and of this touch message reproducing a gentle wake-up music/melody accompanied by a sensation of caress perceived by the wearer.

The design criterion of the configuration signal comprises operating data of the sound interface 3. More precisely, these operating data of the sound interface 3 comprise at least one frequency and at least one amplitude defined for each piezoelectric element 4 constituting said interface 3. In particular, these operating data comprise:

- the duration of broadcasting of the acoustic signal;
- at least one operating instant/period of each piezoelectric element 4 with respect to the duration of broadcasting, i.e.:
  - a single operating instant during all or part of the period of broadcasting of the acoustic signal, or
  - a sequence of operating instants during the period of broadcasting of the acoustic signal, and
- for each operating instant:
  - a vibration frequency and a vibration amplitude, or
  - a vibration frequency and a sequence of amplitudes, or
  - a sequence of vibration frequencies and a sequence of vibration amplitudes, or
  - a sequence of vibration frequencies and a vibration amplitude.

It should be noted that the sequence of vibration frequencies may comprise only frequencies that are similar or substantially similar, or only frequencies that are different or substantially different, or a combination of similar and different frequencies. Likewise, the sequence of amplitudes may comprise only similar or substantially similar amplitudes, or only different or substantially different amplitudes, or a combination of similar and different amplitudes.

This step 11 next comprises a substep 13 of generating the configuration signal from said design criterion. During this substep 13, the processing unit 2 designs, using this design criterion, the configuration signal that makes it possible to control each piezoelectric element 4 of this sound interface 3 individually and/or separately. This configuration signal is next sent by the processing unit 2 to the sound interface 3. Such a signal comprises separate control instructions for each piezoelectric element 4 during the period of broadcasting of the acoustic signal associated or not with the broadcasting of the touch message.

On reception of this configuration signal, the sound interface 3 sends/broadcasts to the wearer the acoustic signal associated or not with the broadcasting of the touch message. Thus this acoustic signal may correspond non-limitatively and non-exhaustively to:

- a brief and/or short sound/noise with at least one variable amplitude and/or at least one variable frequency;
- a long sound/noise with at least one variable amplitude and/or at least one variable frequency;
- a succession of brief and/or short sounds, and/or of long sounds/noises with at least one variable amplitude and/or
- at least one variable frequency;
- a music/melody, or
- a succession of musics/melodies.

If the broadcasting of the acoustic signal is accompanied by a broadcasting of the touch message, then the broadcasting of this sound/noise is associated, non-limitatively and non-exhaustively, with:

- the production of a contour of a graphical representation such as a pattern/symbol, a letter or a number in a tactile fashion, that is to say such as can be achieved by the movement of the tip of a finger of an individual on the skin of the wearer;
- the application of the graphical representation to the skin of the wearer, for example the application of the shape of a letter or of a symbol/pattern;
- the generation of an undulatory and/or vibratory phenomenon aimed for example at creating for the wearer a gentle, pleasant or sensuous or conversely unpleasant tactile perception.

The invention also relates to a computer program comprising program code instructions for the execution of steps 10 to 13 of this method when said computer program is executed by the processing unit 2 of the watch 1.

The invention claimed is:

1. A method for broadcasting an acoustic signal to a wearer of a watch, comprising:

identifying an event relating to a function of the watch (1), the event being an activation of an operation mode of the watch, sending a configuration signal relating to said identified event to a sound interface (3) of the watch (1), the sound interface (3) comprising a plurality of piezoelectric elements (4) mounted on at least one deformable support element (9), said plurality of piezoelectric elements (4) being separately controllable, and said plurality of piezoelectric elements (4) and said at least one deformable support element (9) together being configured to produce a sound, producing a sound of a mechanical watch movement by said plurality of piezoelectric elements (4) and said at least one deformable support element (9), in accordance with the operation mode of the watch, wherein the plurality of piezoelectric elements (4) and said at least one deformable support element (9) are further configured to produce a touch message able to be broadcast to the wearer, and the method further comprises causing the plurality of piezoelectric elements (4) and said at least one deformable support element (9) to produce a caress touch message, wherein the sending of the configuration signal comprises selecting a design criterion for the configuration signal relating to said identified event and information used to separately control each of the piezoelectric elements (4) of the sound interface (3) such that the piezoelectric elements (4) are able to provide at least one of a sound able to be broadcast to the wearer, wherein the touch message includes the production of a contour of a graphical representation in a tactile manner, and wherein the graphical representation includes at least one of a pattern, a symbol, a letter and a figure, and wherein the design criterion comprises operating data of the sound interface (3) comprising at least one vibration frequency and at least one vibration amplitude, the at least one vibration frequency and the at least one vibration amplitude being defined for each piezoelectric element (4) constituting said interface (3).

2. The method according to claim 1, wherein the configuration signal comprises a duration of a broadcasting of the acoustic signal.

3. The method according to claim 1, wherein the configuration signal comprises at least one operating instant/period of each piezoelectric element (4) with respect to a duration of broadcasting, the at least one operating instant/period corresponding to at least one of a single operating instant during all or part of a duration of a broadcasting of the acoustic signal, and a sequence of operating instants during the duration of the broadcasting of the acoustic signal.

4. The method according to claim 3, wherein the configuration signal comprises, for each operating instant, at least one of:

- a vibration frequency and a vibration amplitude;
- a vibration frequency and a sequence of vibration amplitudes;
- a sequence of vibration frequencies and a sequence of vibration amplitudes, and
- a sequence of vibration frequencies and a vibration amplitude.

5. The method according to claim 1, wherein the configuration signal comprises separate instructions for controlling each piezoelectric element (4) of the sound interface (3) during a period of a broadcasting of a message.

6. A watch comprising:

a sound interface (3) including a plurality of piezoelectric elements (4) mounted on at least one deformable support element (9), said plurality of piezoelectric elements (4) being separately controllable, and a processing unit (2), said processing unit (2) being connected to said sound interface (3) and configured to:

identify an event relating to a function of the watch (1), the event including an activation of an operation mode of the watch, send a configuration signal relating to said identified event to the sound interface (3), the configuration signal comprises a design criterion relating to said identified event and information used to separately control each of the piezoelectric elements (4) of the sound interface (3), such that said plurality of piezoelectric elements (4) and said at least one deformable support element (9) produce a sound of a mechanical watch movement, wherein the design criterion comprises operating data of the sound interface (3) comprising at least one vibration frequency and at least one vibration amplitude, the at least one vibration frequency and the at least one vibration amplitude being defined for each piezoelectric element (4) constituting said interface (3), wherein the plurality of piezoelectric elements (4) and said at least one deformable support element (9) are configured to produce a caress touch message able to be broadcast to a wearer of the watch, and wherein the caress touch message includes the production of a contour of a graphical representation in a tactile manner, and wherein the graphical representation includes at least one of a pattern, a symbol, a letter and a figure.

7. The watch (1) according to claim 6, wherein the sound interface (3) is included in at least one of a watch case (1) and a wristlet of the watch (1).

8. A non-transitory computer readable medium storing code instructions, which, when executed by at least one processor, cause the at least one processor to:

identify an event relating to a function of a watch (1), the event being an activation of an operation mode of the watch, send a configuration signal relating to said identified event to a sound interface (3) of the watch (1), the sound interface (3) comprising a plurality of piezoelectric elements (4) mounted on at least one deformable support element (9), said plurality of piezoelectric elements (4) being separately controllable, and said plurality of piezoelectric elements (4) and said at least one deformable support element (9) together being configured to produce a sound, cause the plurality of piezoelectric elements (4) and said at least one deformable support element (9) to produce a sound of a mechanical watch movement in accordance with the operation mode of the watch, and cause the plurality of piezoelectric elements (4) and said at least one deformable support element (9) to produce a caress touch message wherein the sending of the configuration signal comprises selecting a design criterion for the configuration signal relating to said identified event and information used to separately control each of the piezoelectric elements (4) of the sound interface (3) such that the piezoelectric elements (4) are able to provide at least one of a sound able to be broadcast to the wearer, wherein the design criterion comprises operating data of the sound interface (3) comprising at least one vibration frequency and at least one vibration amplitude, the at least one vibration frequency and the at least one vibration amplitude being defined for each piezoelectric element (4) constituting said interface (3), and wherein the touch message includes the production of a contour of a graphical representation in a tactile manner, and wherein the graphical representation includes at least one of a pattern, a symbol, a letter and a figure.

* * * * *